US012523203B2

(12) United States Patent
Clark et al.

(10) Patent No.: US 12,523,203 B2
(45) Date of Patent: Jan. 13, 2026

(54) COMMON PLUNGER FOR A LINEAR ACTUATED PUMP

(71) Applicants: SPM Oil & Gas Inc., Fort Worth, TX (US); Bosch Rexroth Corporation, Bethlehem, PA (US)

(72) Inventors: Wesley P. Clark, Weatherford, TX (US); Chandu Kumar, Fort Worth, TX (US); John McCrady, Burleson, TX (US); Jon Frey, Bethlehem, PA (US); Royce Gerngross, Houston, TX (US)

(73) Assignees: SPM Oil & Gas Inc., Fort Worth, TX (US); Bosch Rexroth Corporation

( * ) Notice: Subject to any disclaimer, the term of this patent is extended or adjusted under 35 U.S.C. 154(b) by 187 days.

(21) Appl. No.: 18/250,060

(22) PCT Filed: Jul. 14, 2021

(86) PCT No.: PCT/US2021/041690

§ 371 (c)(1),
(2) Date: Apr. 21, 2023

(87) PCT Pub. No.: WO2022/015889

PCT Pub. Date: Jan. 20, 2022

(65) Prior Publication Data

US 2024/0011473 A1 Jan. 11, 2024

Related U.S. Application Data

(60) Provisional application No. 63/051,878, filed on Jul. 14, 2020.

(51) Int. Cl.
*F04B 9/113* (2006.01)
*F04B 1/02* (2006.01)
(Continued)

(52) U.S. Cl.
CPC ..... *F04B 9/113* (2013.01); *F04B 1/02* (2013.01); *F04B 5/02* (2013.01); *F04B 53/02* (2013.01)

(58) Field of Classification Search
CPC .... F04B 9/113; F04B 1/02; F04B 5/02; F04B 53/02; F04B 9/02; F04B 15/02; F04B 17/04; F04B 17/03
See application file for complete search history.

(56) References Cited

U.S. PATENT DOCUMENTS 3,143,075 A * 8/1964 Giroux ..... F04B 5/00 417/521
3,771,912 A * 11/1973 Conlee ..... F04B 53/14 91/287

(Continued)

FOREIGN PATENT DOCUMENTS

WO 2020037283 A1 2/2020

OTHER PUBLICATIONS

International Search Report and Written Opinion issued in Application No. PCT/US2021/041690; Dated Oct. 20, 2021, 8 Pages.

*Primary Examiner* — Dominick L Plakkoottam

(57) ABSTRACT

A linear pump assembly includes a cylinder piston disposed in a generally tubular internal cylinder chamber defined within a cylinder housing having first and second ends, a first plunger-cylinder rod securely coupled to a first end of the cylinder piston and disposed in a first generally tubular internal plunger chamber defined within a first plunger housing in linear alignment with the cylinder housing, and a second plunger-cylinder rod securely coupled to a second end of the cylinder piston and disposed in a second generally tubular internal plunger chamber defined within a second plunger housing in linear alignment with the cylinder housing and the first plunger housing. First and second fluid ends
(Continued)

are coupled to the first and second plunger housings respectively, the first and second fluid ends each housing a suction valve and a discharge valve.

19 Claims, 4 Drawing Sheets

(51) Int. Cl.
*F04B 5/02* (2006.01)
*F04B 53/02* (2006.01)

(56) References Cited

U.S. PATENT DOCUMENTS

| | | | | |
|---|---|---|---|---|
| 4,276,003 | A | 6/1981 | Perkins et al. | |
| 6,079,959 | A * | 6/2000 | Kingsford | F04B 53/164 417/393 |
| 6,158,967 | A * | 12/2000 | Dupre | F04B 9/1372 277/300 |
| 8,424,596 | B2 | 4/2013 | Bebb | |
| 8,449,265 | B2 * | 5/2013 | Marica | F04B 15/02 417/215 |
| 2010/0124511 | A1 * | 5/2010 | Li | F04B 53/144 92/172 |
| 2011/0123363 | A1 * | 5/2011 | Marica | F04B 9/105 417/279 |
| 2014/0105759 | A1 * | 4/2014 | Henry | F04B 47/06 417/415 |
| 2018/0135606 | A1 * | 5/2018 | Oklejas, Jr. | F04F 13/00 |

* cited by examiner

COMMON PLUNGER FOR A LINEAR ACTUATED PUMP

CROSS-REFERENCE TO RELATED APPLICATIONS

This application is a 371 National Phase of PCT Application No. PCT/US2021/041690, filed Jul. 14, 2021, entitled "COMMON PLUNGER FOR A LINEAR ACTUATED PUMP," and claims the benefit of and priority to U.S. Provisional Patent Application No. 63/051,878, filed on Jul. 14, 2020, entitled "COMMON PLUNGER FOR A LINEAR ACTUATED PUMP," the disclosures of which are hereby incorporated by reference herein in their entirety.

FIELD

The present disclosure relates to positive displacement pumps, and in particular, to a common plunger configuration for a linear actuated pump.

BACKGROUND

Large pumps are commonly used for mining and oilfield applications, such as, for example, hydraulic fracturing. During hydraulic fracturing, fracturing fluid (i.e., cement, mud, frac sand, and other materials) is pumped at high pressures into a wellbore to cause the producing formation to fracture. One commonly used pump in hydraulic fracturing is a high-pressure reciprocating pump, like the SPM® Destiny$^{SM}$ TWS 2500 frac pump or the SPM® QEM 3000 Continuous Duty Frac Pump, manufactured by S.P.M. Oil & Gas, a Caterpillar Company of Fort Worth, Texas. In operation, the fracturing fluid is caused to flow into and out of a pump fluid chamber by the reciprocating movement of a piston-like plunger moving away from and toward the fluid chamber. As the plunger moves away from the fluid chamber, the pressure inside the chamber decreases, creating a differential pressure across an inlet valve, drawing the fracturing fluid through the inlet valve into the chamber. When the plunger changes direction and begins to move towards the fluid chamber, the pressure inside the chamber substantially increases and the inlet valve closes, the differential pressure across an outlet valve increases, which causes the outlet valve to open to allow the highly pressurized fracturing fluid to discharge through the outlet valve into the wellbore.

A typical frac unit is powered with a diesel engine driving a frac pump through a multispeed transmission. The rotational energy transferred to the reciprocating frac pump is channeled to horizontally-oriented plunger bores for pumping via crankshaft and conn rods. The operating conditions are often extreme involving high fluid flow and high operating pressures (oftentimes up to 15,000 psi). Pressure fluctuations as seen in diesel powered units or other internal combustion-based units often cause undesirable cyclic stresses on components, shortening their lives.

DETAILED DESCRIPTION

The introduction of natural gas as "free fuel" for the frac job has led to investigation for the best way to turn natural gas into frac pumping power. One choice for a prime mover is a large gas turbine generator that creates electrical power to run the frac job on electricity. Since electric drive is not limited to the maximum diesel engine power feasible for a mobile frac unit, a larger or more powerful pump configuration becomes attainable. Larger pumps would mean fewer units required on location, which would translate to a lower total cost devoted to equipment at each frac site.

Reciprocating pumps have many moving parts and so do the power systems that drive them. Replacing reciprocating pumps and their associated drive systems with a linear pump that is electrically actuated provides many advantages. The present disclosure describes a new configuration for a linear pump.

Figure 1:
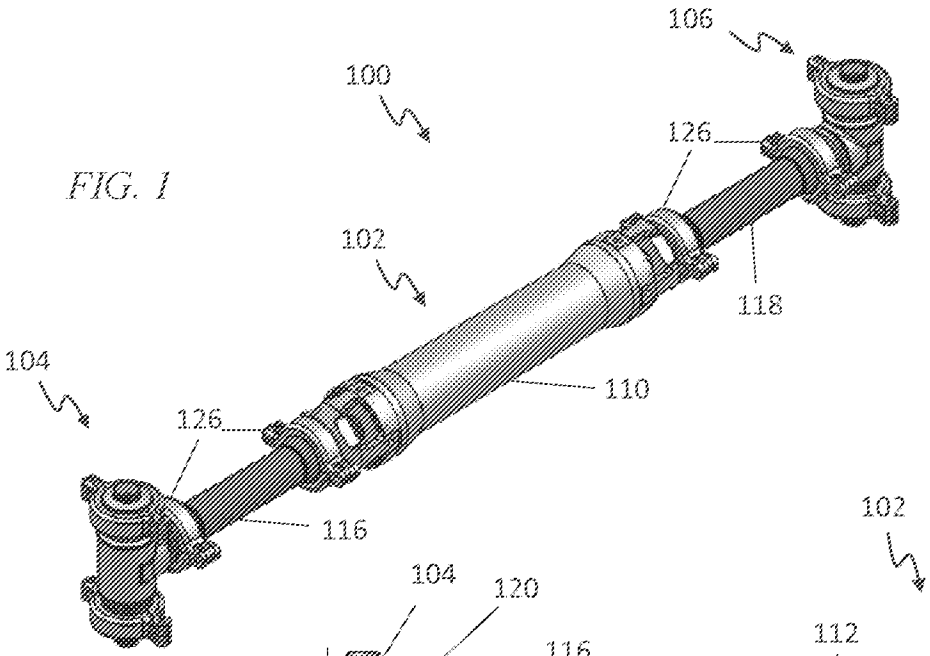
FIG. 1 is a perspective view of an embodiment of a linear pump with a common plunger according to the teachings of the present disclosure.
Figure 2:
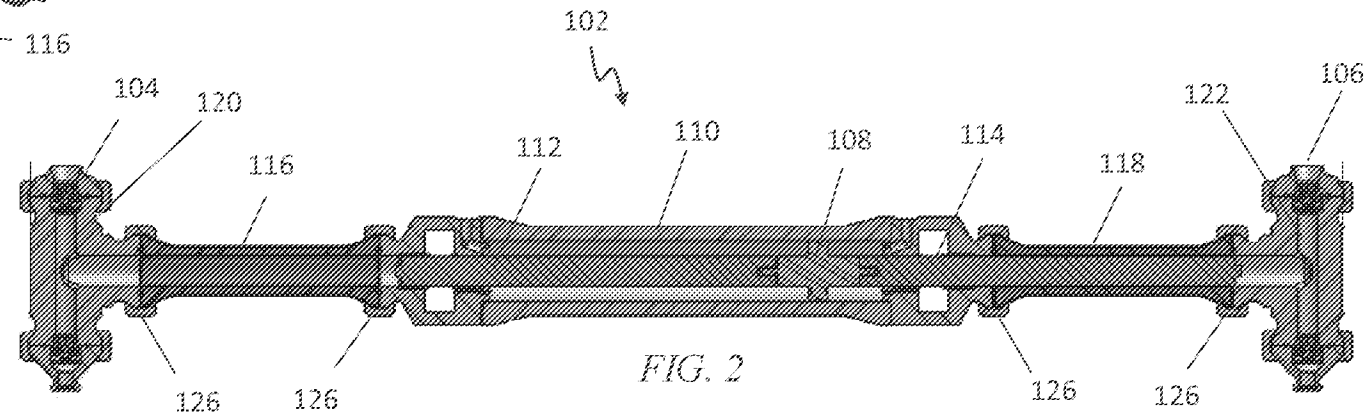
FIG. 2 is a cross-sectional view of an embodiment of a linear pump with a common plunger according to the teachings of the present disclosure.

Referring to FIGS. 1 and 2, a linearly actuated double-action pump 100 includes a centrally-disposed drive system 102 coupled to two fluid ends 104 and 106 at either end along a linear axis. The pump 100 includes a cylinder piston 108 disposed inside the cylinder chamber of a cylinder housing 110. The cylinder piston 108 is coupled to two plunger-cylinder rods 112 and 114 coupled on either side of the cylinder piston 108 along a linear axis. The plunger-cylinder rods 112 and 114 are each housed inside a plunger housing 116 and 118 respectively that are coupled to the cylinder housing 110. The fluid ends 104 and 106 are coupled to the plunger housings 116 and 118, respectively, and they define fluid chambers 120 and 122 that have inlet and outlet ports controlled by suction and discharge valves. As shown in the figures, the cylinder housing 110 and plunger housings 116 and 118 are securely coupled to form the linear configuration using clamps 126. Alternately, suitable bolted flanged connections may be used. In this design, the elimination of the conventional pony rods and using the cylinder rods as the plunger reduces the overall length and weight of the pump assembly.

In operation, the centrally-situated drive system 102 causes the cylinder piston 108 and plunger-cylinder rods 112 and 114 to move along a linear axis in either direction within the cylinder housing and plunger housings. The reciprocating movement of the plunger-cylinder rods 112 and 114 causes frac fluid to be drawn in and discharged from the fluid chambers of the fluid ends 104 and 106. In this way, the two fluid ends 104 and 106 are driven by a common plunger that works to alternately pump the frac fluid inside both fluid chambers. The plunger-cylinder rods 112 and 114 are the components that are in contact with a hydraulic fluid within the cylinder housing 110 that acts on the cylinder piston 108, and the plunger-cylinder rods 112 and 114 are also the components that are in contact with the frac fluid in the fluid ends 104 and 106.

Figures 3, 4, 5:
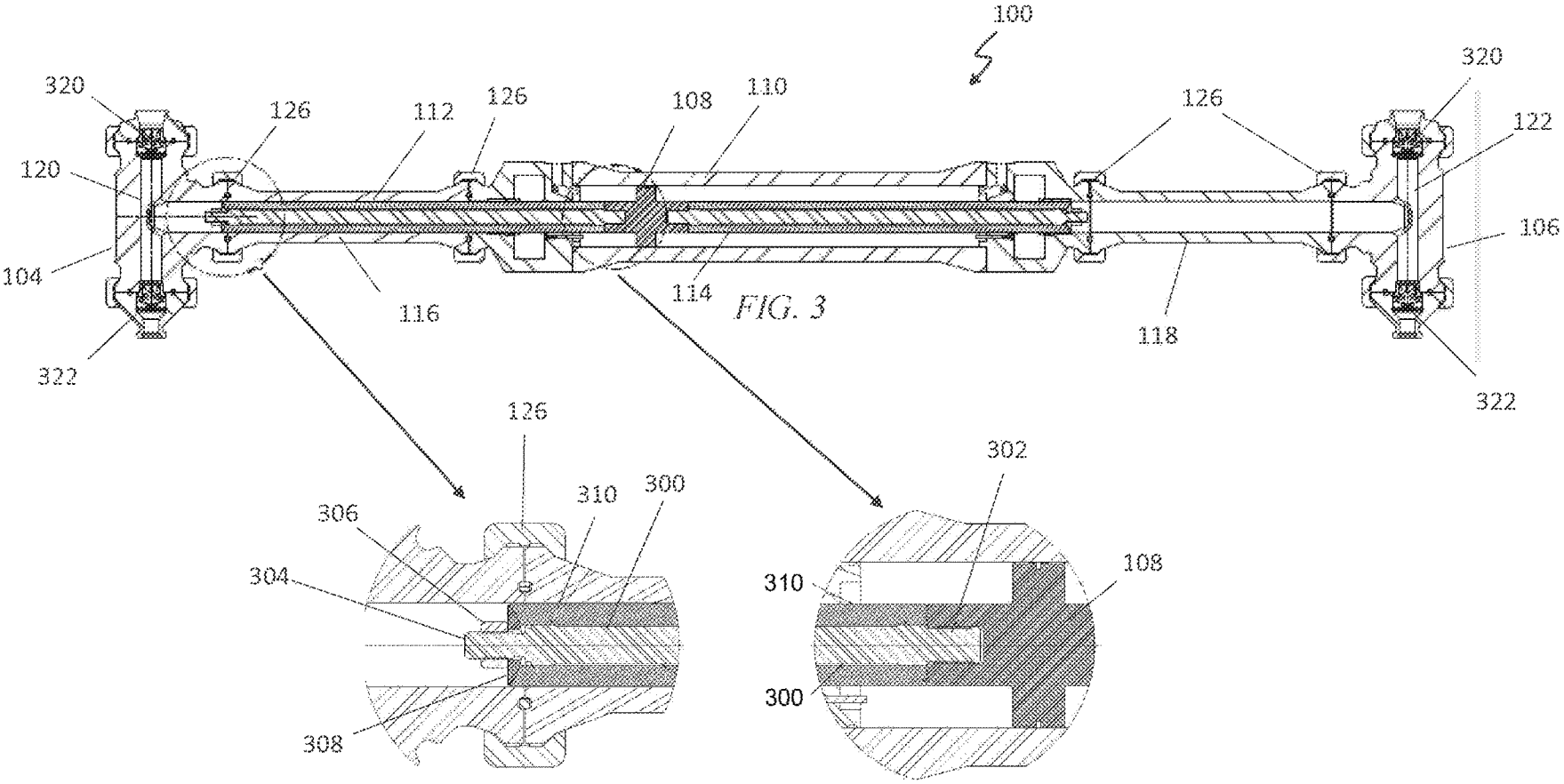
FIGS. 3-5 are cross-sectional detailed views of an embodiment of the linear pump with a common plunger according to the teachings of the present disclosure.

FIG. 3 is a cross-sectional view of the linear pump 100, and FIGS. 4 and 5 show further details of the plunger-cylinder rods 112 and 114 and their attachment to the cylinder piston 108. Each plunger-cylinder rod may include a center rod 300 that includes an externally-threaded nub 302 at one end that interfaces with an internally-threaded cavity of the cylinder piston 108. The plunger-cylinder rod includes an externally-threaded nub 304 at the other end that interfaces with a nut 306 that engages and holds a washer 308 in place. The nut 306 is used to ensure a sleeve 310 installed over the rod 300 remains in place and remains tightly abutting against the cylinder piston 108. The same construction is used for both plunger-cylinder rod on either side of the cylinder piston 108. As referenced above, each fluid end 104 and 106 includes a suction valve 320 that allows the frac media to be drawn into the fluid chamber and a discharge valve 322 that allows the frac media to be discharged from the fluid chamber. The frac fluid is thus drawn in and discharge by the two fluid ends 104 and 106 in an alternating manner.

Figure 6A:
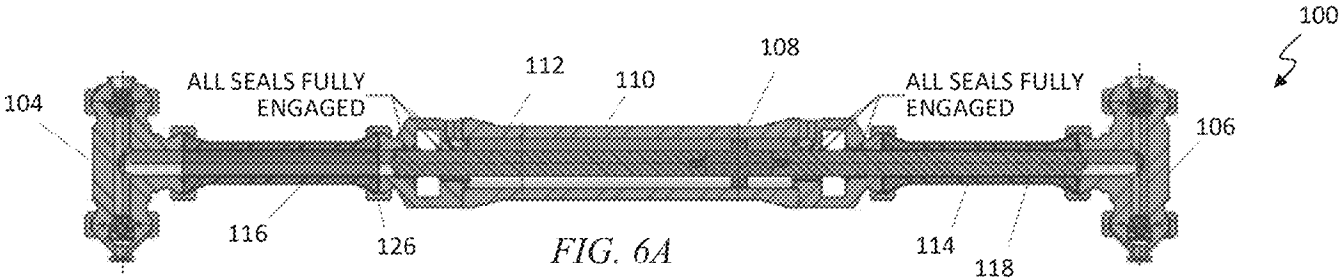
FIGS. 6A and 6B are partial cross-sectional and cross-sectional side views of the linear pump in its operational arrangement.
Figure 6B:
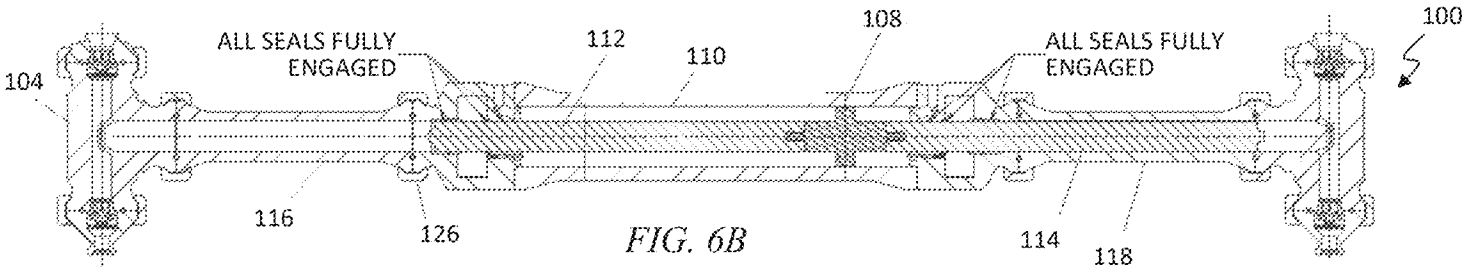

FIGS. 6A and 6B are partial cross-sectional and cross-sectional side views of the linear pump 100 in its operational arrangement. In FIGS. 6A and 6B, all seals and packing that are used to maintain the separation of the frac medium in the fluid chambers of the fluid ends 104 and 106 from the hydraulic fluid inside the cylinder housing 110 are fully engaged to maintain a separation between the hydraulic fluid in the cylinder housing and the frac fluid in the plunger housing. The design may also include deflectors 704 (FIG. 7C) disposed proximate at the interfaces between the cylinder chamber and the plunger chamber that are designed to deflect the frac fluid in the plunger chamber from entering and contaminating the cylinder chamber in the event of seal failure. The profile of the deflector may be an angled or chamfered surface, or it may have a semicircular contour. As the cylinder piston moves between the first end position and the second end position, mechanisms are in place to scrape the plunger-cylinder rods so that the frac fluid doesn't contaminate the hydraulic fluid in the cylinder chamber.

Figure 7A:
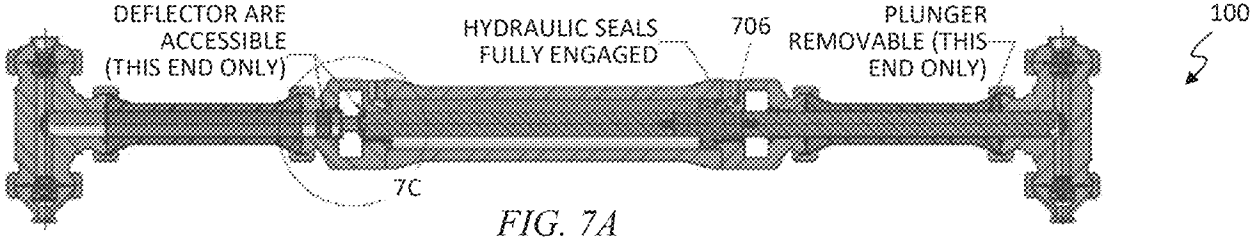
FIGS. 7A and 7B are partial cross-sectional and cross-sectional side views of the linear pump in its first maintenance position.
Figure 7C:
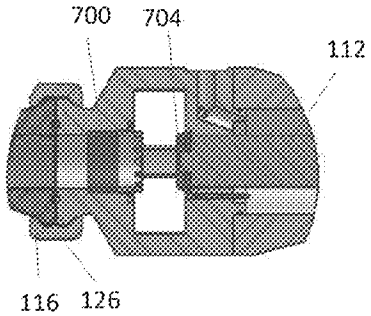
FIG. 7C is an enlarged view, corresponding to the circle labeled 7C in FIG. 7A, of the linear pump in its first maintenance position; and, FIGS. 8A and 8B are partial cross-sectional and cross-sectional side views of the linear pump in its second maintenance position.
Figure 7B:
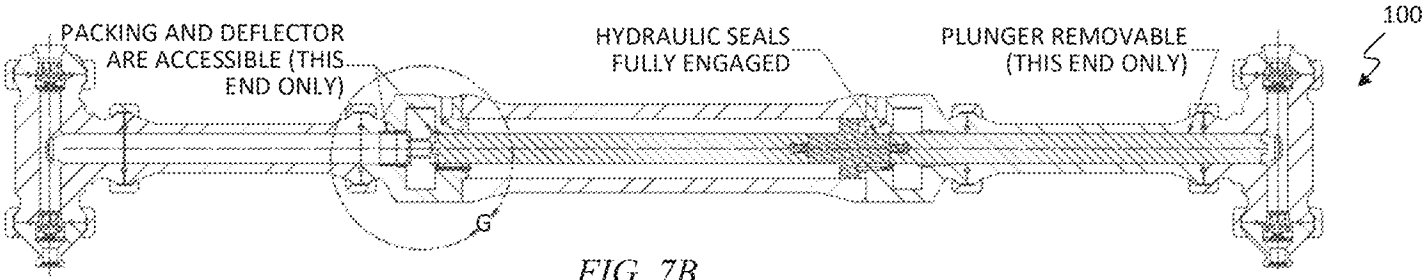

FIGS. 7A and 7B are partial cross-sectional and cross-sectional side views of the linear pump 100 in its first maintenance position where the cylinder piston 108 is displaced to the second end of the cylinder chamber to allow access to the seals and packing 700 and the defector 704 on the first end of the pump. In this configuration, the plunger-cylinder rod at the second end can have maintenance performed on it or be replaced as the hydraulic seals 706 at the cylinder piston 108 near the second end remain fully engaged.

Figure 8A:
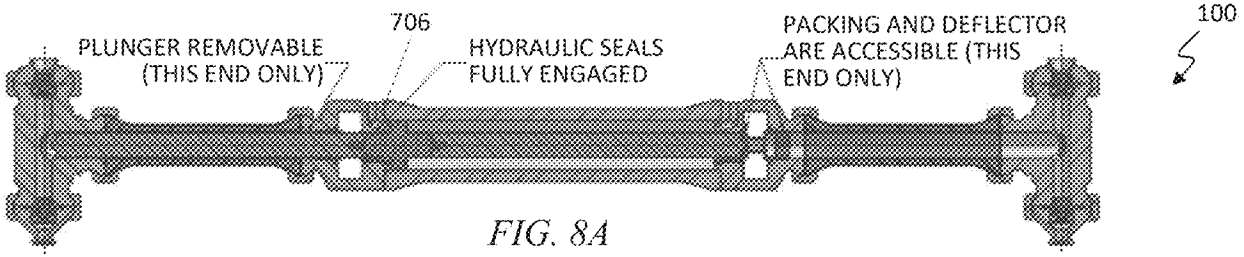
Figure 8B:
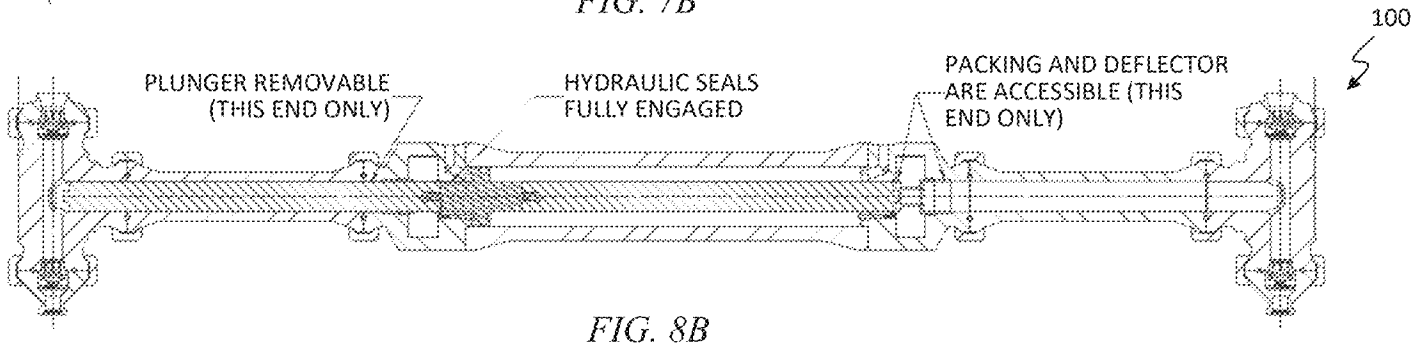

FIGS. 8A and 8B are partial cross-sectional and cross-sectional side views of the linear pump 100 in its second maintenance position where the cylinder piston 108 is displaced to the first end of the cylinder chamber to allow maintenance access to the seals and packing and the defector on the second end of the pump. In this configuration, the plunger-cylinder rod at the first end can have maintenance performed on it or be replaced as the hydraulic seals at the cylinder piston 108 near the first end remain fully engaged.

The present disclosure describes an embodiment in which the pony rod is eliminated to shorten the overall length of the linear pump, as well as to lighten the weight of the pump assembly. The cylinder piston and the plunger-cylinder rods on either side thereof may be of a single piece construction. Alternatively, a three-piece embodiment includes a cylinder piston constructed as a separate unit and coupled to a plunger-cylinder rod on either side as shown in these figures. In both embodiments, the plunger-cylinder rods function as the plunger in both fluid ends.

In an example embodiment, an electric linear pump may use a planetary screw drive (e.g., planetary gears surrounding a threaded rod to convert rotational motion of the planetary gears to the linear translation movement of the threaded rod) to linearly move (i.e., translate) the cylinder piston instead of the traditional diesel engines. In other embodiments, the electric actuator may be in the form of a winding that uses electric current to create a magnetic field to move the rod along its axis (e.g., similar to solenoid actuation). A fluid end is coupled with each of the two plunger ends to control fluid charging on the suction stroke and pressure discharge on the power stroke. The electricity supplied to the planetary thread drive may be provided from the grid or produced by an onsite generator using local natural gas, thus minimizing fuel costs.

The linear pump assembly may also include a control module (not explicitly shown), such as a computer with associated software installed therein, to cooperatively operate the drive system and hydraulic actuators so that the fluid output from the fluid end is smooth with minimized fluid pulsation. A number of sensors may be used to measure and monitor a variety of pump operating characteristics and fed to the control module. The monitored pump characteristics may include, for example, fluid pressures, fluid flow rate, motor speed, etc.

In some embodiments, multiple pump assemblies, such as from two to eighteen units, may be used for redundancy and configured to maintain a constant or steady output flow (i.e., smooth output). In different implementations, different plunger sizes and fluid end sizes (e.g., different product families) may be provided for a range of pressures needed for different applications.

An example embodiment of a mobile fracking pump trailer includes a gas turbine engine operable at a desired engine speed, and an engine output shaft coupled to the gas turbine engine for rotation at a desired engine shaft output speed. The fracking pump configured for pumping a fracking slurry down a wellbore would include a fracking pump input shaft operable at a desired pump input speed, a torque converter assembly comprising a torque converter that fluidly couples the engine output shaft and the fracking pump input shaft, where the torque converter is operable at a desired torque converter input speed and provides a variable torque converter output speed for delivering power to the fracking pump at the desired pump input speed according to its pumping load without requiring shifting of gears. Further included is a first reduction gearing connected between the engine output shaft and a torque converter input shaft for reducing the desired engine shaft output speed to the desired torque converter input speed transmitted to the torque converter. A first power takeoff is connected to the first reduction gearing. Also included is an electrical system for distributing electrical power to the mobile fracking pump trailer, and an electrical machine connected to the first power takeoff for selectively driving the engine output shaft through the first reduction gearing when energized by an offboard electrical power source to start the gas turbine engine in a starting mode. The electrical system is powered by the electrical machine after the gas turbine engine is started by an offboard electrical power source. The gas turbine engine, the torque converter assembly, the fracking pump, the first reduction gearing, the first power takeoff, the electrical system, and the electrical machine are preferably configured to fit in an operating arrangement on a single platform so that the mobile fracking pump trailer can be transported on roads as one unit.

The features of the present invention which are believed to be novel are set forth below with particularity in the appended claims. However, modifications, variations, and changes to the exemplary embodiments described above will be apparent to those skilled in the art, and the linear actuated pump assembly with a common plunger described herein thus encompasses such modifications, variations, and changes and are not limited to the specific embodiments described herein.

What is claimed is:

1. A linear pump assembly comprising:

a cylinder housing defining a generally tubular internal cylinder chamber having first and second ends disposed along a longitudinal axis and containing a cylinder piston;

at least one plunger housing coupled to at least one end of the cylinder housing respectively and each defining a generally tubular internal plunger chamber in linear alignment with the longitudinal axis of the generally tubular internal cylinder chamber, the at least one plunger housing being configured to contain at least a portion of a plunger-cylinder rod securely coupled to the cylinder piston; and at least one fluid end coupled to the at least one plunger housing, the at least one fluid end housing a suction valve and a discharge valve, the cylinder piston being configured to be displaced between first and second operational end points by a pressurized hydraulic fluid circulating in the cylinder housing, configured to cause at least the portion of the plunger-cylinder rod to be displaced within the at least one plunger housing and a frac fluid to be pumped in through the suction valve and out through the discharge valve, and the plunger-cylinder rod being configured to contact the frac fluid in the at least one fluid end, wherein the plunger-cylinder rod comprises:

a rod having a first protruding nub and a second protruding nub, the second protruding nub being engaged with a cavity of the cylinder piston;

a sleeve configured to enclose the rod;

a washer configured to overlay and engage a first end of the sleeve and the first protruding nub; and a nut configured to engage the first protruding nub, secure the sleeve in place, and maintain a second end of the sleeve tightly abutting the cylinder piston.

2. The linear pump assembly of claim 1, wherein the cylinder piston and the plunger-cylinder rod are fabricated as a unitary construction.

3. The linear pump assembly of claim 1, wherein the first protruding nub includes a protruding threaded nub configured for threaded engagement with the nut.

4. The linear pump assembly of claim 1, further comprising seal packing disposed near an interface between the generally tubular internal cylinder chamber and the generally tubular internal plunger chamber configured to maintain fluid isolation between the generally tubular internal cylinder chamber and the generally tubular internal plunger chamber.

5. The linear pump assembly of claim 1, further comprising a chamfered surface disposed near an interface between the generally tubular internal cylinder chamber and the generally tubular internal plunger chamber configured to function as a fluid deflector to maintain fluid isolation between the generally tubular internal cylinder chamber and the generally tubular internal plunger chamber.

6. The linear pump assembly of claim 1, further comprising a semicircular surface disposed near an interface between the generally tubular internal cylinder chamber and the generally tubular internal plunger chamber configured to function as a fluid deflector to maintain fluid isolation between the generally tubular internal cylinder chamber and the generally tubular internal plunger chamber.

7. A linear pump assembly comprising:

a cylinder housing defining a cylinder chamber having first and second ends disposed along a longitudinal axis containing a cylinder piston;

first and second plunger housings coupled to the first and second ends of the cylinder housing respectively and the first plunger housing defining a plunger chamber in linear alignment with the longitudinal axis of the cylinder chamber, the first plunger housing being configured to contain at least a portion of a first plunger-cylinder rod securely coupled to the cylinder piston, and the second plunger housing being configured to contain at least a portion of a second plunger-cylinder rod securely coupled to the cylinder piston; and first and second fluid ends coupled to the first and second plunger housings respectively, the first fluid end housing a suction valve and a discharge valve, the cylinder piston being configured to be displaced between first and second operational end points by a pressurized hydraulic fluid circulating in the cylinder housing to cause the first plunger-cylinder rod to be displaced and cause a frac fluid to be pumped in through the suction valve and out through the discharge valve, and the first plunger-cylinder rod being configured to contact the frac fluid in the first fluid end, wherein the first plunger-cylinder rod comprises:

a rod having a first protruding nub and a second protruding nub, the second protruding nub being engaged with a cavity of the cylinder piston;

a sleeve configured to enclose the rod;

a washer configured to overlay and engage a first end of the sleeve and the first protruding nub; and a nut configured to engage the first protruding nub, secure the sleeve in place, and maintain a second end of the sleeve tightly abutting the cylinder piston.

8. The linear pump assembly of claim 7, wherein the cylinder piston, the first plunger-cylinder rod, and the second plunger-cylinder rod are fabricated as a unitary construction.

9. The linear pump assembly of claim 7, further comprising seal packing disposed near an interface between the cylinder chamber and the plunger chamber configured to maintain fluid isolation between the cylinder chamber and the plunger chamber.

10. The linear pump assembly of claim 7, further comprising a contoured surface disposed near an interface between the cylinder chamber and the plunger chamber configured to function as a fluid deflector to maintain fluid isolation between the cylinder chamber and the plunger chamber.

11. The linear pump assembly of claim 7, wherein the first protruding nub includes a protruding threaded nub configured for threaded engagement with the nut.

12. A linear pump assembly comprising:

a cylinder piston disposed in a cylinder chamber defined within a cylinder housing having first and second ends;

a first plunger-cylinder rod securely coupled to a first end of the cylinder piston and configured to be disposed in a first plunger chamber defined within a first plunger housing in linear alignment with the cylinder housing;

a second plunger-cylinder rod securely coupled to a second end of the cylinder piston and configured to be disposed in a second plunger chamber defined within a second plunger housing in linear alignment with the cylinder housing and the first plunger housing; and first and second fluid ends coupled to the first and second plunger housings respectively, the first and second fluid ends each housing a suction valve and a discharge valve, the cylinder piston being configured for reciprocating displacement between first and second operational end points by a pressurized hydraulic fluid circulating in the cylinder housing, causing the first and second plunger-cylinder rods to be displaced within the respective plunger housings, and further causing a frac fluid to be pumped in through the first and second fluid ends in an alternating manner, and the first plunger-cylinder rod being configured to contact the frac fluid in the first fluid end, wherein the first plunger-cylinder rod comprises:

a rod having a first protruding threaded nub engaged with a threaded cavity of the cylinder piston; and a threaded nut configured to engage a second protruding threaded nub of the rod and maintain the first plunger-cylinder rod tightly abutting the cylinder piston.

13. The linear pump assembly of claim 12, wherein the cylinder piston, the first plunger-cylinder rod, and the second plunger-cylinder rod are fabricated as a unitary construction.

14. The linear pump assembly of claim 12, further comprising seal packing disposed near an interface between the cylinder chamber and the first plunger chamber configured to maintain fluid isolation between the cylinder chamber and the first plunger chamber.

15. The linear pump assembly of claim 12, further comprising a chamfered surface disposed near an interface between the cylinder chamber and the first plunger chamber configured to function as a fluid deflector to maintain fluid isolation between the cylinder chamber and the first plunger chamber.

16. The linear pump assembly of claim 12, wherein the first plunger-cylinder rod further comprises a sleeve configured to enclose the rod.

17. The linear pump assembly of claim 16, wherein the threaded nut is further configured to secure the sleeve in place.

18. The linear pump assembly of claim 16, wherein the first plunger-cylinder rod further comprises a washer configured to overlay and engage a first end of the sleeve.

19. The linear pump assembly of claim 18, wherein the threaded nut is further configured to maintain a second end of the sleeve tightly abutting the cylinder piston.

* * * * *